United States Patent [19]

Schweitzer

[11] Patent Number: 4,887,447

[45] Date of Patent: Dec. 19, 1989

[54] REBAR CUTTING AND BENDING MACHINE

[76] Inventor: Len Schweitzer, 3272 Susileen Dr., Reno, Nev. 89509

[21] Appl. No.: 208,351

[22] Filed: Jun. 17, 1988

Related U.S. Application Data

[63] Continuation-in-part of Ser. No. 59,703, Jun. 8, 1987, Pat. No. 4,798,078.

[51] Int. Cl.[4] ..... B21D 28/00

[52] U.S. Cl. ..... 72/332; 72/324; 72/389; 83/200; 83/605

[58] Field of Search ..... 72/389, 324, 325, 326, 72/479, 384, 212, 213, 332; 83/600, 605, 602, 673, 674, 199, 200

[56] References Cited

U.S. PATENT DOCUMENTS

| | | | |
|---|---|---|---|
| 812,452 | 2/1906 | Richards | 83/200 |
| 1,265,345 | 5/1910 | La Rock | 83/200 |
| 3,996,782 | 12/1976 | Sgariglia | 72/332 |

FOREIGN PATENT DOCUMENTS

| | | | |
|---|---|---|---|
| 388561 | 8/1908 | France | 83/200 |
| 0683862 | 9/1979 | U.S.S.R. | 83/200 |
| 657997 | 10/1951 | United Kingdom | 83/200 |

*Primary Examiner*—David Jones
*Attorney, Agent, or Firm*—Townsend and Townsend

[57] ABSTRACT

A hand-operated rebar cutting apparatus including first and second discs carried by a shaft mounted on a frame. The discs are pivotable relative to each other and each includes grooves which can be aligned for receipt of a bar to be cut. The first discs is pivotal on a shaft carried by a frame and moves incrementally through a predetermined arc such that the grooves become substantially axially offset from each other. The appartus is attached to a manually operable bender and straightener having a linearly reciprocable slide mounted within a guideway. As the slide is reciprocated, the first and second discs of the apparatus are pivoted relative to each other. The apparatus includes a ratchet mechanism for allowing incremental pivoting of the discs relative to each other through the predetermined arc, while allowing reciprocable movement of the slide to its initial position without returning the first and second discs to the position in which the grooves are aligned. The apparatus also includes return means for pivotally returning the first discs in a second direction through the entire predetermined arc during a single return stroke of the slide. When the grooves are substantially axially offset from each other, a bar placed in the aligned groove is thereby cut.

30 Claims, 3 Drawing Sheets

REBAR CUTTING AND BENDING MACHINE

This application is a continuation-in-part of U.S. Ser. No. 059,703, filed June 8, 1987 now U.S. Pat. No. 4,798,078 by the applicant of the present invention.

BACKGROUND OF THE INVENTION

This invention relates to an apparatus for cutting metal bars, such as bars used during construction to reinforce concrete, generally known as rebars, and in particular to such a device which is portable and can be used on the ground at construction sites.

U.S. Pat. No. 4,594,875, issued June 17, 1986 to the inventor hereof, the disclosure of which is incorporated herein by reference, discloses and claims an improved rebar bending machine which is lightweight, hand operated and adapted to be used in the field by a single person. It has a laterally stabilized, elongated base and, mounted to the base a pair of spaced apart forming posts which straddle a slide mounted pair of lugs that form between them a groove into which rebar to be bent is placed. The slide is movable in an elongated guideway in a direction perpendicular to a line interconnecting the centers of the forming posts so that the groove defined by the lugs can be moved from a first position, at which a rebar placed in the groove is substantially tangent to the peripheries of the posts, past the line interconnecting the post centers, to a second position on the other side of the posts. In the course of this linear movement of the grooves a bend is formed in that portion of the rebar disposed between the lugs. Depending upon the length of travel of the lugs a bend of less than equal to or greater than 90° is formed in the rebar although 90° bends are by far the most common.

That patent further discloses to generate the relatively large bending forces with an elongated handle that is pivotally attached to the base. Suitable linkage connected to the handle and the slide translates the pivotal handle movements into linear slide motions.

To minimize the weight of the bending machine, and to maximize the bending force, the slide, post and linkage are arranged so that the slide does not travel substantially more than the distance it must travel to effect the greatest bend in the bar typically a bend of not more than about 120°. In this manner, the overall length of the device in general and of the slide, base and guideway in particular can be minimized, which saves weight, labor and costs. Within a given size and configuration of the machine, the bending force that can be generated with the manually operated handle can be maximized. An effective, high speed and accurate bending of the rebar is thus possible with the device of that patent.

Bending machines constructed in accordance with the above-mentioned patent have been on sale for more than a year and have met with exceptional success. It is believed that the success is to a large extent attributable to its compact size, relatively low weight and to its easy operation even on the uneven ground frequently encountered at construction sites.

At construction sites, it is frequently necessary to cut a bent or straight rebar. Although many rebar cutters are known and available, they are usually heavy, stationary, and/or machine-operated devices which, not infrequently, are relatively remote from the place where a rebar is being bent with a bending machine of the type disclosed in the '875 patent. Thus, the bar to be cut must be hand-carried to the cutting machine, wherever it may be located, cut, and then returned to the location where it will be used. This is time-consuming, for large diameter and/or long rebars constitutes heavy physical labor, and is, therefore, costly.

U.S. Ser. No. 059,703, now U.S. Pat. No. 4,798,078, the parent of the present application, discloses a machine for cutting rebar adapted to be attached to the improved rebar bending machine disclosed in the '875 patent discussed above. This cutting machine has a pair of closely adjacent cutting discs, one stationary and the other pivotal relative thereto, both of which include a peripherally open slot into which the rebar to be cut can be placed. The discs are mounted in a frame, preferably defined by two spaced apart, rigidly interconnected plates which have an upright portion through which a pivot shaft for the discs extends and a relatively horizontal portion which is used to connect the cutter with the rebar bending machine of the '875 patent.

In use, a rebar is placed in the aligned slots. An operator lowers the handle to move a slide and engage the roller of an arm connected to one of the cutting discs, causing relative movement of the discs and a corresponding rotational offset of the two slots of the discs, thereby severing the rebar. This cutter is a significant improvement over the prior art, allowing rebar cutting at the site with a simple, rugged, lowcost device. However, a relatively large force is still required to rotate the disc especially when cutting larger diameter rebar. The total force required to cut the rebar must be applied in one stroke. Thus, relatively heavy physical labor is still required. In particular, at times so much force must be applied to the handle that slightly built workers might have insufficient weight to push the handle down.

SUMMARY OF THE INVENTION

The present invention provides a significantly improved cutting machine which enhances the usefulness of the bending machine disclosed in the '875 patent, discussed above, by making it possible to cut, as well as bend, even relatively large diameter rebar with the same basic bending machine and at the location where the rebar is to be used, thereby eliminating the need to hand carry the rebar to a separate cutting machine. This cutting machine may be used by almost any construction worker because a significantly lesser force is required to operate it.

This is achieved, in accordance with the present invention, by providing a pair of closely adjacent cutting discs which are incrementally movable relative to each other through a "predetermined arc", i.e., that arc required to cut the rebar. Each disc includes an axially oriented groove which can be aligned with the groove of the other disc.

A force exerted by the construction worker in order to pivot the discs relative to each other moves the discs only an increment, i.e. through less than the predetermined arc, thereby reducing the total force that must be exerted in a single stroke. The first increment of relative movement begins to cut the rebar, although, alone, it is insufficient to sever it. With one or more additional increments of movement, the rebar is further cut until it is fully severed.

Generally speaking, the rebar cutting machine of the present invention has a pair of closely adjacent cutting discs, one stationary and the other pivotal relative to the one, both of which include a peripherally open groove into which the rebar to be cut can be placed. The discs are mounted in a frame, preferably defined by two spaced apart, rigidly interconnected plates which have an upright portion through which a pivot shaft for the discs extends, and a relatively horizontal portion which is used to connect the cutter to an activating mechanism. The pivot shaft is preferably a bolt which is sufficiently tightened to generate substantial friction between the discs. This facilitates the cutting of rebar and the operation of the devices as is further described below.

In the preferred embodiment of the invention the cutter is used with and actuated by a rebar bending machine as generally described in the above-referenced '875 patent, although other means for activating the cutter can be employed. Turning now momentarily to the construction of such a rebar bending machine, it has a base including a hollow guideway for the slide adjacent one end of the base. The guideway for the base is open and the slide is constructed and movable so that one end thereof projects from the open guideway end when the slide is in one of its limiting positions of travel. The guideway is at the end of the base which includes the lateral stabilizer.

The horizontal portion of the cutter frame includes an upwardly open recess into which the base and/or the lateral stabilizer can be dropped. The slots are formed so as to constrain the base to the horizontal portion of the cutter frame. i.e., to prevent relative movement between the two, both in a direction parallel to the slide movement and a (horizontal) direction perpendicular thereto.

The connection of the cutter to the bending machine is simple. The operator lifts the end of the bending machine, aligns it with the recess in the horizontal portion of the frame, and drops it into registration with the recess. Since the weight of the bending machine rests on the horizontal portion of the frame, the two are effectively constrained and secured to each other.

Although for operational purposes the rebar cutter can be permanently secured to the base of the bending machine, for example by welding, bolting, or otherwise permanently securing the base to the horizontal portion of the cutter frame, it is preferred to have the two easily detachable so that the bending machine can be used without the cutter. Thus, the cutter is coupled to the bending machine only when rebar cutting is required.

Turning now again to the cutting machine of the present invention, the movable disc includes a radial extension, a free end of which is spaced from and generally parallel to the horizontal portion of the frame. An obliquely inclined push bar has a first, lower end defined by a roller that is movable along a guide track formed by the horizontal portion of the frame in alignment and parallel to the reciprocating slide of the bending machine when the bending machine and the cutter of the present invention are operatively connected. A second, upper end of the push bar is proximate the free end of the radial extension of the movable disc and forms a plurality, e.g., three steps or recesses, each of which is engageable with the free end of the radial extension.

A link is pivotally connected to the radial extension and the second end of the push bar and constrains the two to each other while permitting limited relative movements between them in a manner further described below. In addition, a spring biases the upper end of the push bar towards the free end of the extension.

The rebar cutter of the present invention further includes a hook pivotally connected to the push bar, e.g., coaxially with the roller at the lower end thereof, and extending between the upright plates of the frame towards the bending machine so that the hook can be engaged with one of the lugs projecting upwardly from the reciprocating slide of the bending machine.

The push bar, the steps at the upper end thereof, and the free end of the radial extension of the movable disc are configured and positioned relative to each other so that when the axial cutting grooves of the discs are aligned, the lower end of the push bar is at its first or initial position where it is proximate the reciprocating slide of the bending machine when the slide is fully retracted into its elongated guideway. Activation of the handle of the bending machine moves the slide against the lower end of the push bar, thereby pushing it along the guide track formed by the frame of the cutter. As a result of the interengagement between the lug and the first step at the upper end of the push bar, the radial extension and therewith the movable disc are pivoted by an amount which is a function of the linear slide movement.

The push bar, the free end of the radial extension and the steps at the upper end of the push bar are formed and arranged so that for maximum pivotal movement of the bending machine handle the rotational movement of the first disc is less than the amount of rotational movement required to fully offset the rebar cutting grooves in the disc. In a present preferred embodiment the geometry is selected so that the movable disc pivots through an arc of approximately one-third to one-half the full predetermined arc the disc must be pivoted through to fully offset the rebar cutting grooves in the discs.

Upon the return movement of the slide from its terminal position toward its initial position, by raising the handle of the bending machine, the return hook pulls the lower end of the push bar with the slide. The significant friction generated between the stationary and movable discs referred to earlier prevents the latter from following the return movement of the push bar even though the two are interconnected by a spring biasing them towards each other. In addition the return link interconnecting the free end of the radial disc extension at the upper end of the push bar provides sufficient freedom of motion between the two so that the push bar, as its lower end follows the slide, permits relative slidable motions between the free end of the extension and the first step at the upper end of the push bar. When the free extension end reaches the second step in the push bar the biasing force exerted by the spring snaps the two together so that the free extension end seats in the second step of the push bar. This changes the connecting geometry between the two so that, immediately thereafter, the operator can again lower the handle of the bending machine. The slide again presses against the lower end of the push bar, and thereby causes a further incremental pivotal movement of the movable disc. This incremental advancement of the movable disc can be repeated any number of times, depending on the construction and geometry of the cutter that is employed, until the two grooves are fully offset from each other. At that point the rebar has been cut.

Thereafter, the operator raises the handle to fully retract the slide of the bending machine into its guideway and move it back to its initial position. The hook attached to the lower end of the push bar and engaging the slide follows this motion, thereby pulling the lower end of the push bar along with it.

The frame includes a guide which prevents the roller at the lower end of the push bar from lifting off the track during this return movement. In a preferred embodiment of the invention this guide is formed by a protrusion extending from an inside of one of the plates and positioned so as to engage a generally upwardly facing side thereof intermediate its two ends. As a result of this constraint on the path the push bar can follow during the return movement, the upper end of the push bar in effect pivots about the roller at the lower end while the roller remains in contact with or proximate to the track. The double pivoted link connecting the push bar and the free end of the radial extension follows the movement of the upper push bar end and thereby pivots the disc through the entire predetermined arc back to its original position at which the cutting grooves in the disc are axially aligned.

As a result of this construction of the cutting machine of the present invention rebar is cut by operating the pivotal actuating handle of the bending machine a plurality of times, e.g., two or three times to effect the pivotal movement of the cutting disc through the predetermined arc and thereby sever the rebar placed into the aligned cutting grooves of the disc. This significantly reduces the amount of force that must be applied by the worker to cut the bar. Thus even slightly built workers can readily operate it.

Cutting is further made easier because after the initial or first activation of the handle it needs to be raised only partially for each subsequent activation. This leaves the handle at a less steeply inclined orientation as that the workman has a better mechanical advantage when he applies a force e.g. his weight to the handle. In addition, when the operator retracts the slide, by raising the handle of the bending machine after the completion of an incremental cutting step, an audible click signals to him when he can reverse the handle motion and again push downwardly to pivotally advance the cutting disc an additional increment.

After the completion of the cut, however, return of the disc to its original position, in which the cutting grooves of both discs are aligned, is accomplished with a single reverse stroke of the handle from its inclined to its fully raised position. This reduces the amount of time required for readying the cutting machine of the present invention for another cut and, therefore, enhances its efficiency.

DETAILED DESCRIPTION OF THE PREFERRED EMBODIMENTS

Figure 1:
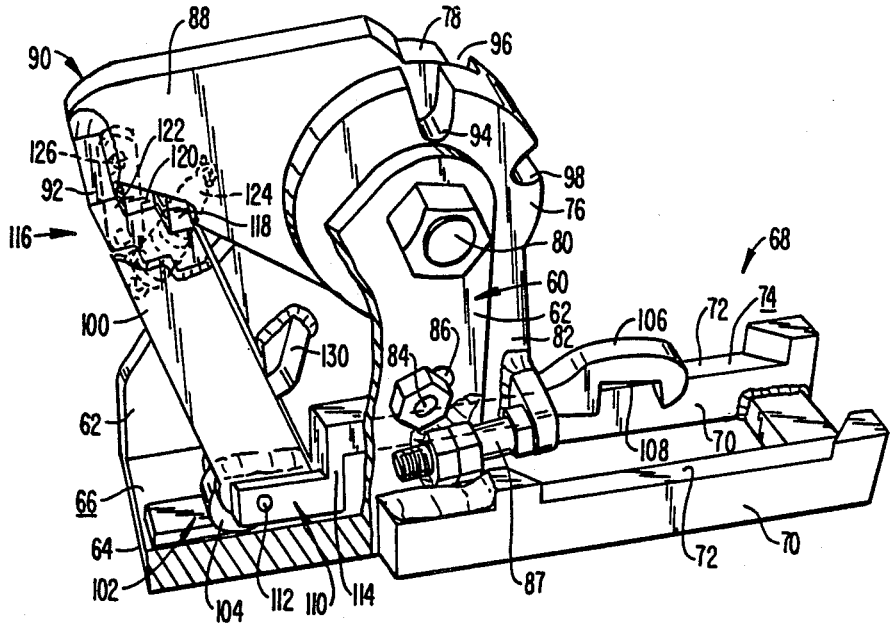
FIG. 1 is a perspective, side elevational view of a cutting machine constructed in accordance with the present invention, with parts broken away, and illustrates the relative position of two cutting discs after the completion of a cut.

Referring first to FIGS. 1, 2, 7 and 8, and initially describing a portable, hand-operated rebar bending machine 2 with which a rebar cutter 4 of the present invention is preferably used, it comprises an elongated base 6, a bending mechanism 8 at one end of the base and an actuating handle 10 operatively coupled with the bending mechanism. To provide stability for the machine the base includes generally transversely oriented cross-legs 12 at one end thereof and a transversely extending yoke 14 at the other end of the base and which forms part of the bending mechanism. To reduce the weight of the machine while maintaining rigidity, the base and the cross-legs are preferably constructed from steel pipe.

Yoke 14 forms one end of the base and supports and houses the bending mechanism 8. It includes a tubular center section 16, which is secured, e.g. welded to or integrally constructed with the proximate end of an elongated steel pipe 18 which forms the major portion of the base, and a pair of angularly inclined arms 20, 22 which laterally protrude from the center section to either side thereof. The free ends of the arms are joined, e.g., welded together, for strength and rigidity. The upwardly facing surfaces of the center section 16 and arms 20, 22 are flat and lie in a common plane to define a flat, horizontal support surface for the rebar to be bent by the machine.

The tubular center section 16 of the yoke defines an internal, elongated, linear guideway 26 which has an open end facing cutter 4 and which linearly reciprocally mounts an elongated slide 28 which is movable between an initial or retracted position and a terminal or extended position. One end of the slide projects from the open guideway when the slide is in its terminal position.

The slide includes a pair of spaced apart lugs 30 which protrude through an elongated, upwardly open slot 32 in the tubular center section 16 of the yoke. The lugs have opposing convexly arcuate bending surfaces 34 which define between them a first groove 36 of a sufficient width so that straight rebar to be bent can be placed in to the groove. The height of the lugs is typically greater than the diameter of the largest rebar capable of being bent by the machine, i.e. the height is greater than the width of groove 36.

A pair of bending posts 38 are positioned on a line perpendicular to the guideway 26 at the outward ends of arms 20, 22. Each post comprises a shaft 40 firmly secured, e.g. welded to the yoke and protruding upwardly past the flat support surface 24. A roller 42 is rotatably carried by the protruding portion of the shaft 40 and is suitably restrained to the shaft to prevent relative axial movements of the roller. Each roller has a height greater than the diameter of the largest rebar capable of being bent by the machine and a concave peripheral surface 44 for nesting the rebar during bending.

Handle 10 is preferably an elongated section of steel pipe having a free end 46 which is proximate cross legs 12 and a second end which is pivotal about a pivot shaft 48 carried on supports 50 protruding upwardly from the base. A lever 52 fixed e.g. welded to the second end of the handle is angularly inclined relative to and extends from the handle past the pivot shaft towards guideway 26. A link 54 has its respective ends pivotally attached to the free end of the lever and the proximate end of slide 28. The link translates pivotal movements of handle 10 and the lever 52 into correspondingly reciprocating, linear movements of the slide 28 in guideway 26.

Figure 2:
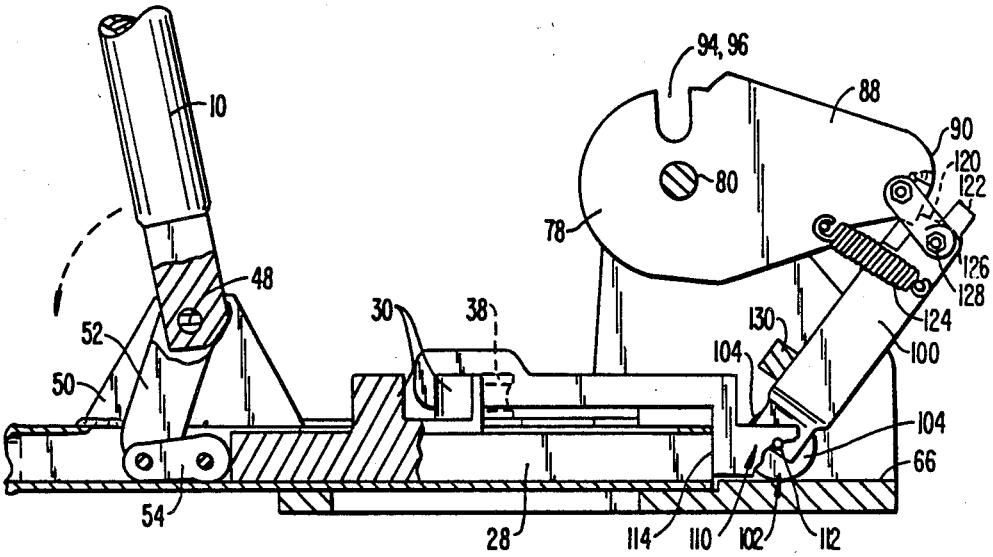
FIG. 2 is a fragmentary, side elevational view, partially in section, and illustrates the cutting machine of the present invention in operative engagement with a rebar bending machine used to actuate the cutter.
Figure 7:
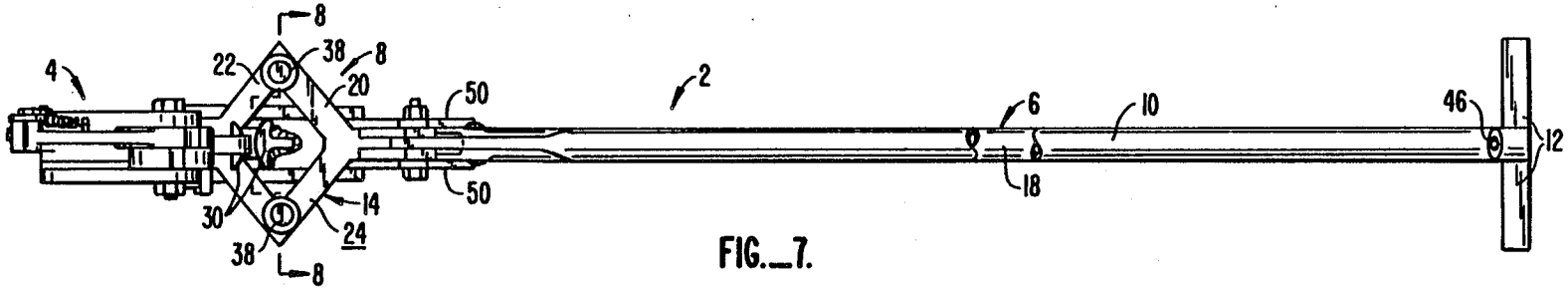
FIG. 7 is a plan view of a rebar bending machine with which the cutter of the present invention is preferably used.
Figure 8:
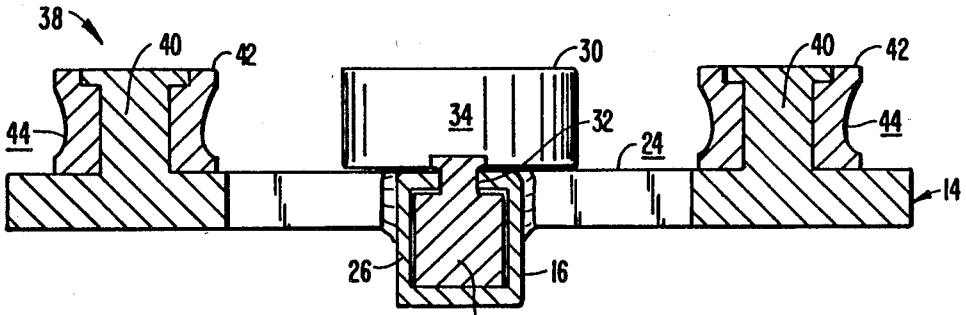
FIG. 8 is a front elevational view in cross section and is taken on line 8—8 in FIG. 7.

In use the lever is fully raised so that the groove between jaws 30 is disposed to the left of bending post rollers 42 as seen in FIG. 7. Next, rebar 4 is placed into the groove and the operator lowers handle 10 in a clockwise direction, as seen in FIG. 2, until it is in a substantially horizontal position. This causes a corresponding linear movement of the slide within guideway 26 and, thereby, moves jaws 30 from the left hand side of post 38 to the right hand side thereof. In the course of this movement a bend is formed in the rebar.

The rebar bending device is particularly adapted for use in the rough environment typically surrounding construction sites. It is relatively lightweight and is readily carried by one person. Cross-legs 12 and the laterally protruding arms 20, 22 of yoke 14 assure stability of the device even when placed on uneven ground. Tubular center section 16, which defines guideway 26, protects slide 26 from contact with abrasive ground, sand, etc. In addition slide 28 is relatively long, e.g. five to ten times its width, to provide accurate guidance as it reciprocates within guideway 26 without causing wedging even when the forces applied by lugs 30 to the rebar tend to skew the slide.

Still referring now to FIGS. 1, 2, 7 and 8, the construction of rebar cutter 4 of the present invention will be described in detail. It has a frame 60 including a pair of spaced apart, upright plates 62. Their lower ends are interconnected by a horizontal member 64, the upwardly facing surface of which defines a horizontal track 66. The frame further includes a forwardly (towards cutting machine 2) extending connector 68 defined by spaced apart, generally vertically oriented bars 70. Recesses 72 formed in the upper surfaces of the vertical bars have a depth equal to the height or thickness of angular arms 20, 22 of bending machine yoke 14. Further, ends 74 of the recesses are positioned and oriented so that the yoke can be placed into the recess with little play. For the illustrated embodiment, in which the yoke of the bending machine is diamond-shaped, the ends 74 of the recesses have angular orientations which correspond to the angular orientation of the sides of the yoke.

To connect cutter 4 of the present invention to a bending device 2, the cutter is placed on the ground and yoke 14 of the bending machine is lifted and positioned above recess 72 in cutter frame 60. The end of base 6 opposite from the yoke is preferably slightly raised, so as to incline the yoke and point the open end of the guideway slightly downwardly. When so inclined, the yoke is lowered to seat it in the recess, thereby aligning the open end of the guideway with the space between upright plates 62 of the frame and slightly above horizontal track 66. Thereafter, the opposite end of base 6 (from which cross-legs 12 extend) is lowered until the entire yoke is nested in the recess. At this point, the yoke is fully supported on the ground by vertical bars 70 of connector 68 and cross-legs 12 of the base support the opposite end thereof. The bending machine and the cutter of the present invention are now ready for use.

Returning now to the construction of cutter 4, a first, stationary disc 76 and a second, pivotable disc 78 are carried by a bolted shaft 80 extending between upright plates 62. The bolt is firmly tightened so that there is no play between the discs and sufficient friction is generated between them to prevent the pivotable disc from rotating freely on the disc, i.e., without the need to apply a substantial force to it.

The fixed disc includes a downwardly depending arm 82, the free end of which is secured to the proximate upright plate 62 with a bolt 84 extending through a slot 86 (illustrated in FIG. 1 only). The bolt prevents the arm, and thereby disc 76 from pivoting on shaft 80. A slot 86 permits slight adjustments of the position of the fixed disc. A threaded screw 87 on the side of plate 62 is preferably to facilitate precise adjustments in the position of the fixed disc.

The pivotable disc has a radial extension 88 that terminates in a free end 90 and includes a generally downwardly facing lug 92. Both discs further include at least one set of axially alignable rebar cutting grooves 94, 96. Groove 94 in the fixed disc is positioned so that it faces generally upwardly, as is clearly shown in FIG. 1, when bolt 84 secures arms 82 to the adjoining plate 62. If desired, a second set of axially alignable grooves 98 may be provided for cutting rebar of a different, e.g., smaller diameter, for example.

A push bar 100 operatively connects the free end 90 of extension 88 with slide 28 of bending machine 2 to effect relative pivotal movement of disc 76 through a predetermined arc in a plurality of increments from an original position, in which rebar cutting grooves 94, 96 are axially aligned, to a terminal position in which the grooves are fully axially offset (as illustrated in FIG. 1, for example). A lower end 102 of the push bar is appropriately bifurcated to provide space for a roller 104 which is mounted on a shaft 112 and rests on and can roll along track 66 of horizontal frame member 64. The lower end further pivotally mounts a return hook 106, the forward (towards bending machine 2) end of which has a notch 108 of a sufficient width so that the notch loosely engages the lug 30 on slide 28 of the bending machine closest to cutter 4. In a presently preferred embodiment of the invention, hook 106 has a bifurcated end 110 which straddles lower end 102 of the push bar. It is also secured to shaft 112.

As is best seen in FIG. 2, the end of slide 28 of bending machine 2 projecting from the open end of guideway 26 is opposite from a forwardly facing skirt 114 of the hook. When bending machine handle 10 is lowered and slide 28 is moved to the right, as seen in FIG. 2, to extend it from the open guideway end, the projecting end of the slide engages skirt 114 of the hook and thereby pushes the hook and the lower end of push bar 100 to the right, again as seen in FIG. 2. Notch 108 in hook 106 is dimensioned so that substantially no force is transmitted from lug 30 to the hook when the bending machine handle is operated to extend the slide out of its guideway. When the handle is raised, to retract the slide into the guideway, however, the lug 30 engages the notch in hook 106 to thereby pull the lower end 102 of the push bar with it.

An upper end 116 of the push bar is defined by a plurality, e.g. three successive steps or recesses 118, 120 and 122. The first step is lowest and closest to shaft 80 for pivotal disc 76 while step 122 is highest and furthest removed from the shaft. Further, a tension spring 124 has its respective ends attached to radial extension 88 and an upper portion of push bar, respectively. It biases the upper end of the push bar towards the radial extension.

A link 126 is used for the return of the disc from its terminal to its home position, as further described below, and has a first end pivotally secured to the radial extension 88 adjacent the free end 90 thereof. The other end of the link is pivotally attached to the upper end 116 of the push bar. An elongated slot in the link at one or the other pivot points thereof, say, at its pivot with the push bar permits limited relative movements between the lug 92 on the extension and steps 120, 122, 124 over a distance slightly greater than the height of one step for purposes further described below.

Referring now to FIGS. 1–8, with emphasis on FIGS. 3–6, the operation of cutter 4 of the present invention is as follows. Initially, the cutter is connected to bending machine 2 as was described above (or to another actuator), actuating handle is fully raised (to correspondingly fully retract slide 28 into guideway 26 to its initial position) and notch 108 in return hook 106 is engaged with lug 30 attached to the slide. The free end of the slide is now immediately opposite skirt 114 of the hook.

Figure 3:
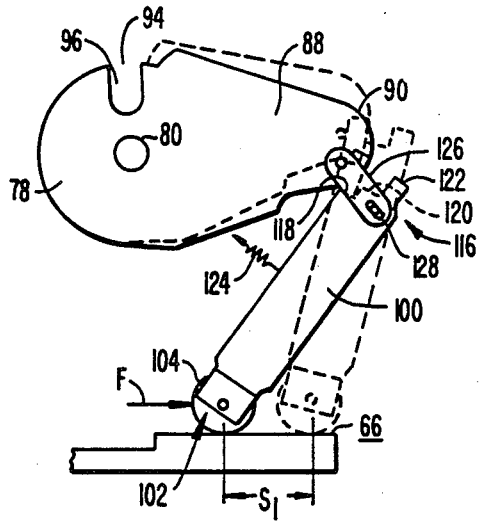
FIGS. 3–6 are fragmentary, schematic, side elevational views which sequentially illustrate the manner in the movable cutting disc of the cutter of the present invention is incrementally moved through a predetermined arc and returned to its original position.

Cutting grooves 94, 96 in discs 76, 78 are aligned and a rebar to be cut (not separately shown) is placed into the aligned grooves. The relative positions of movable disc 78, extension 88 and push bar 100 are illustrated in the schematic of FIG. 3 in solid lines. It should be noted that lug 92 at the free end of radial extension 88 engages the first step 118 at the upper end 116 of the push bar. Tension spring 124 biases the push bar towards the extension and thus keeps the two engaged.

By lowering handle 10 of the bending machine a horizontally acting force, schematically shown in FIG. 3 by the arrow "F", is applied to the lower end 102 of the push bar. This forces the push bar to the right, as seen in FIG. 3. Since roller 104 engages track surface 66 and lug 92 is frictionally constrained to first step 118, the horizontal movement of the lower push bar end in effect results in a pivotal motion of the push bar about lug 92. This raises the upper end of the push bar into the position shown in FIG. 3 in phantom lines and correspondingly pivotally moves extension 88, and therewith disc 78 into the position shown in phantom lines.

The geometry of the push bar, the extension and the interengaging lug and steps are chosen so that for a maximum horizontal slide motion "$S_1$" from its initial position to its terminal position, resulting from pivotal movement of the handle from its fully raised to its fully lowered horizontal position, disc 78 pivots through an arc which is less, say approximately one-half of the predetermined arc through which it must be rotated to fully offset rebar cutting grooves 94 and 96. When the slide is in its terminal position the grooves are offset as approximately shown in FIG. 3.

Once the handle has been fully lowered, the operator raises it to retract slide 28, and therewith return hook 106 to the left, as seen in FIG. 3. The lower end 102 of the push bar is thereby moved to the left also. The substantial friction between discs 76 and 79 maintains the pivotable disc 76 in its advanced position (illustrated in FIG. 3). i.e., it does not follow the return motion of the push bar. Instead, it leads to a slidable movement between lug 92 and the vertical wall of first step 118. Slot 128 in link 126 is of a sufficient length to permit this relative motion. In addition, tension spring 124 continuously biases push bar in a counterclockwise direction, as seen in FIG. 3, against lug 92. Consequently, the continued retraction of the slide into the guideway eventually aligns lug 92 with second step 120. When this occurs the biasing force of the spring snaps the push bar to the left, as seen in FIG. 3, to seat the lug in the second step. This causes a pronounced, audible click which advises the operator that he can again lower the handle to continue the cutting operation. It should be pointed out that this occurs before the slide has been returned to its initial position, i.e., when its return motion has covered a distance less than "$S_1$".

Figure 4:
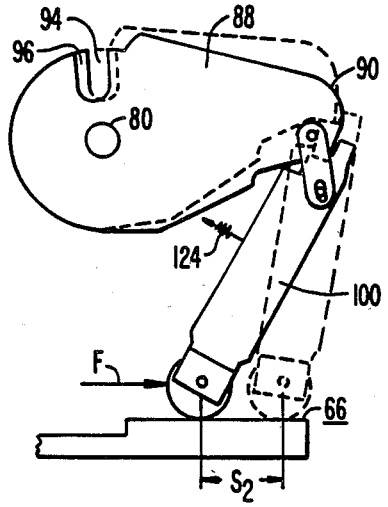

The relative position of the extension 88 and push bar 100 at the beginning of the second incremental pivotal motion of disc 78 through the predetermined arc is illustrated in FIG. 4. By lowering the handle 10 the operator again extends the slide to the right. This moves the lower end 102 of the push bar along track 66 to the right, as seen in FIG. 4, into the position shown in phantom lines, and pivotally moves the extension and the disc a further increment, also as illustrated in phantom lines in FIG. 4. At the end of the second increment, the relative axial offset of cutting grooves 94. 96 is approximately shown in FIG. 4.

Figure 5:
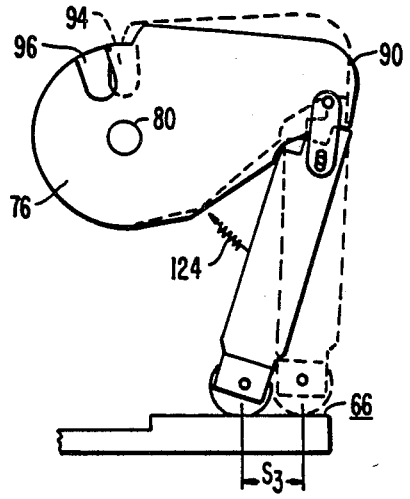

Although the relative dimensioning and positioning of the components of the cutter may be selected so that cutting is completed at the end of the second increment, in the illustrated embodiment this is not the case. After the second cutting increment the cutting grooves are still not fully offset and, therefore, the rebar cutting operation is still not complete. Consequently, the operator repeats the incremental cutting operation by again raising the handle as discussed above to eventually place the push bar 100 and the radial extension 88 into the position shown in FIG. 5 in solid lines. Lug 92 engages the third, highest step 122 of the push bar. By lowering the handle the lower end of the push bar is again to the right, as seen in FIG. 5, into the position shown in phantom lines. This results in a further incremental rotation of the disc 76 and thereby completes its incremental pivotal movement through the predetermined arc. Cutting grooves 94, 96 are now fully axially offset and completing the rebar cutting step is complete.

As is apparent from the foregoing description of how the cutter 4 operates, the push bar and the radial extension of the movable disc, in conjunction with spring 104 and link 126 form in effect a ratchet mechanism for incrementally advancing the disc through the predetermined arc.

Since it is not necessary to move the handle to its fully raised position each incremental step its angular inclination at the start of the second and third steps is substantially less than at the beginning of the operation. Hence, it is easier for the operator to continue cutting because he has a greater available moment arm to push the handle downwardly than is the case when the handle is fully raised. This is of advantage because when severing rebar the amount of cutting force typically is lowest at the beginning of the cutting operation and becomes greatest shortly before the cut is completed. At these points the handle is much less steeply inclined and, therefore, a greater effective (horizontal) moment arm is available. Hence, cutting can be completed with a relatively smaller force.

Since the slide travels a lesser distance during the second and third handle activations, the horizontal distance travelled by the lower end 102 of the push bar during the second and third cutting steps becomes also less. Hence, "$S_1$" (FIG. 3) is greater than "$S_2$" (FIG. 4) and "$S_3$" (FIG. 5).

Upon the completion of the cutting operation the operator grasps handle 10 and brings it to its fully raised position. This retracts slide 28, and with it return hook 106 and lower end 102 of the push bar the full distance "$S_1$" to the left as seen in FIG. 6, until the slide reaches its initial position.

Figure 6:
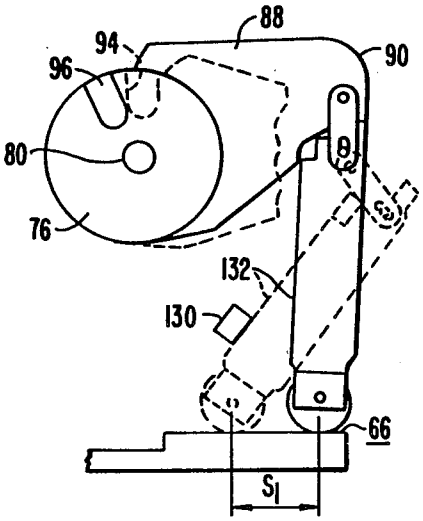

Referring now specifically to FIG. 6, the relative positions of radial extension 88 and push bar 102 at the end of the cutting operation are shown in solid lines. As the lower end 102 of the push bar is moved to the left, as seen in FIG. 6, a guide block 130 secured to one of the upright plates 62 of frame 60 and projecting towards the opposite plate, engages a generally upwardly facing surface 132 of the push bar. The guide block prevents the movable connections between slide lug 30, hook 106, lower push bar end 102, link 126 (after slot 128 thereof bottomed out and engages the pin extending therethrough), and extension 88 from "straightening" in a manner a chain straightens when subjected to tension. Instead the guide block constrains roller 104 to track 66 and induces a pivotal movement of the push bar about shaft 112 so that upper end 116 thereof moves pivotally downward (towards track 66). Link 126 transfers this downward motion to extension 88 and thereby pivots disc 76 to its home position.

It should be noted that in practice the movement of the push bar during the full return of the slide is not a precise pivotal movement about shaft 112. Due to required tolerances roller 104 will normally lift off track 66 and the actual path followed by the push bar will resemble a compound pivotal movement about guide block 130, or about a plurality of points along a short portion of upwardly facing surface 132 of the push bar.

A new cut is commenced by lowering handle 10 of the bending machine to initially move the lower end of the push bar to the right, from the position shown in FIG. 6 in phantom lines to a point where the pin engaging slot 128 and link 126 is spaced from the respective ends of the slot and lug 92 engages the first step 118 at the upper end of the push bar. This position is illustrated in FIG. 3 in solid lines.

I claim:

1. Apparatus for cutting rebar with a manually operable device having a linearly reciprocable slide carried by the device, the apparatus comprising:

a frame adapted to be securely connected to the device and carrying a shaft oriented perpendicular to and radially spaced from the slide:

first and second discs pivotally and nonpivotally, respectively, carried by the shaft, the discs including axially oriented grooves which can be aligned, whereby the grooves become substantially axially offset from each other when the first disc is pivotally moved through a predetermined arc in a first direction from a first position in which the grooves are aligned to a second position:

a ratchet mechanism operatively connecting the first disc with the slide so that pivotable movement of the first disc in the first direction through the predetermined arc requires a plurality of reciprocal slide movements from about an initial position towards a terminal position: and return means operatively coupled with the ratchet mechanism for pivotally returning the first disc in a second direction through the predetermined arc by moving the slide from about the terminal position to the initial position after the first disc has been moved through the predetermined arc in the first direction.

2. Apparatus according to claim 1 wherein the return means includes means for pivotally returning the first disc in the second direction through the entire predetermined arc during a single return stroke of the slide from about the terminal position toward the initial position.

3. Apparatus according to claim 2 wherein the means for pivotally returning the first disc comprises means operatively coupled with the first disc and the ratchet mechanism for translating the linear movement of the slide from the terminal to initial position into rotational movement of the first disc through the predetermined arc.

4. Apparatus according to claim 3 wherein the means for pivotally returning the first disc includes a push bar having a first end and a second end operatively connected with the first disc and the slide, and means positioned on the frame for causing pivotal movement of the push bar about points distributed over a portion of the length of the push bar intermediate its ends.

5. Apparatus according to claim 4 wherein the push bar forms part of the ratchet mechanism and pivots about the means positioned on the frame.

6. Apparatus according to claim 1 wherein the ratchet mechanism comprises a push bar disposed between the slide and the first disc for translating slide movements into pivotal movement of the first disc.

7. Apparatus according to claim 6 wherein the return means includes means for pivotally returning the first disc in the second direction through the entire predetermined arc during a single return stroke of the slide from about the terminal position to the initial position.

8. Apparatus according to claim 7 wherein the means for pivotally returning the first disc comprises means operatively coupling the first disc and the push bar, and a protrusion on the frame positioned to engage the push bar during the return stroke so that the push bar moves along an arcuate path, thereby pivoting the first disc in the second direction.

9. Apparatus according to claim 1 wherein the first disc includes a radial extension for pivoting the first disc and wherein the ratchet mechanism comprises a push bar and is further defined by a plurality of recesses defined by one of the radial extension and the push bar, a recess engaging lug defined by the other of the push bar and the radial extension, means biasing the lug toward the recesses and guide means for engaging successive recesses with the lug during successive movements of the slide from about the initial position toward the terminal position.

10. Apparatus according to claim 9 wherein the guide means guides the push bar translationally and pivotally, causing translational and pivotal movement of the push bar in a first direction, thereby pivoting the first disc in the first direction through the predetermined arc.

11. Apparatus according to claim 10 wherein the guiding means comprises a protrusion on the frame slidably engaging the push bar and wherein the biasing means biases the push bar into engagement with the protrusion.

12. Apparatus according to claim 9 including means operatively coupling a lower end of the push bar remote from the radial extension with the slide, and wherein the guide means guides the push bar along a path so that upon successive movements of the slide toward terminal position, the lug successively engages a recess adjacent the recess previously engaged by the lug.

13. Apparatus according to claim 12 including transfer means for guiding the lower end of the push bar along a path parallel to the path of the direction of movement of the slide.

14. Apparatus according to claim 13 wherein the transfer means comprises a roller.

15. An apparatus for cutting bar adapted to be attached to a bar bending machine, the bar bending machine having an elongated base defining a linear guideway which is open at an end of the base, a slide reciprocally movably disposed in the guideway, and means for reciprocating the slide in the guideway so that in a first initial position an end of the slide is withdrawn into the guideway and in a second terminal position the end of the slide protrudes from the open guideway, the apparatus comprising:

first and second axially aligned cutting discs carried on a shaft, the shaft being spaced from the slide, the second disc being non-pivotally mounted on the shaft, each disc having at least one axially oriented groove adapted to be aligned with a groove on the other disc, the first disc being pivotal on the shaft through an arc sufficient to substantially offset the grooves:

an extension projecting generally radially from the first disc;

means in engagement with the slide and the extension for pivotally moving the first disc relative to the second disc in a first direction over less than the arc when the slide is initially moved toward the terminal position;

means for permitting movement of the slide toward the initial position without causing a corresponding movement of the extension and the first disc;

means for additionally pivotally moving the first disc in the first direction in response to at least a second movement of the slide towards the terminal position to effect pivotal movement of the first disc over the arc;

whereby a bar placed into the aligned grooves is cut when the first disc has been moved over the arc with a plurality of reciprocating slide movements; and return means operatively coupled with the extension and the slide for thereafter pivotally returning the first disc over the arc and thereby realigning the grooves when the slide is moved towards the initial position.

16. Apparatus according to claim 15 comprising means for translating movement of the slide to pivotal movement of the first disc during movement of the slide.

17. Apparatus according to claim 16 wherein the means for translating movement comprises a push bar disposed between the slide and the extension for trans lating slide movements into pivotal first disc movements.

18. Apparatus according to claim 17 including means for biasing an upper end of the push bar opposite from the slide into engagement with the extension.

19. Apparatus according to claim 18 wherein the upper end of the push bar abuts the extension.

20. Apparatus according to claim 19 wherein the abutting portions of the push bar and the extension comprise a ratchet mechanism for effecting pivotal movement of the extension and the first disc over the arc.

21. Apparatus according to claim 19 including a roller positioned at a lower end of the push bar, the slide cooperating with the roller, the roller being guided such that the reciprocating movement of the slide moves the lower end of the push bar parallel to the slide movement, the upper end of the push bar engages the extension and moves the push bar non-parallel to slide movement, and, thereby, causes an arcuate movement simultaneously pivoting the push bar to thereby rotate the first disc.

22. Apparatus according to claim 21 wherein the upper end of the push bar comprises a ratchet mechanism defined by a plurality of recesses defined by one of the radial extension and the push bar, a recess engaging lug defined by the other of the push bar and the radial extension, biasing means biasing the lug toward the recesses, and guide means for engaging successive recesses with the lug during successive movements of the slide from about the initial position toward the terminal position.

23. Apparatus according to claim 15 wherein the extension comprises a free end secured to the first disc for pivoting the first disc relative to the second disc.

24. Apparatus according to claim 15 wherein the return means comprises a portion of the slide extending through the base and an arm connected to the push bar and adapted to engage a portion of the slide extending through the base.

25. Apparatus according to claim 15 wherein each of the first and second discs include a plurality of axial grooves adapted to be aligned with a corresponding plurality of grooves of the other disc.

26. An apparatus for cutting bar adapted to be attached to a manually operable device having an elongated base defining a linear guideway which is open at a first end of the base, a slide reciprocally movably disposed in the guideway, a portion of the slide extending through the elongated base, and means for reciprocating the slide in the guideway so that in a first initial position an end of the slide is withdrawn into the guideway and in a second terminal position the slide end protrudes from the open end of the guideway, the apparatus comprising:

first and second axially aligned cutting discs carried on a shaft, the shaft being spaced from the slide, each disc having at least one axial groove adapted to be aligned with the groove of the other disc, the grooves being adapted to receive a bar to be cut;

means preventing pivotal movement of the second disc on the shaft;

means for pivoting the first disc relative to the second disc through a predetermined arc, the pivoting means comprising an extension having an end secured to the first disc and extending generally radially therefrom, a push bar extending obliquely from the end of the slide to a free end of the extension and having a first end coupled to the slide so that the first end moves with the slide when it reciprocates between initial and terminal positions and a second end operatively coupled with the extension, and means guiding the push bar so that a first movement of the slide from about the initial position toward the terminal position moves the push bar and the extension to cause pivotal movement of the first disc relative to the second disc;

link means disposed between the extension and the push bar permitting limited movement of the slide from the terminal toward the initial position without causing a corresponding movement of the extension and the first disc;

engaging means operatively coupling the push bar with the extension when the slide is again moved toward the terminal position following said limited movement to thereby further pivotally move the first disc through a further portion of the arc, the operatively coupling means being formed to move the first disc in a second direction over the arc when the slide is moved from about the terminal position to about the initial position so that the grooves in the first and second disc are again aligned;

whereby a bar placed in the aligned disc grooves is cut when the reciprocating means is repeatedly operated to move the slide toward the terminal end of the guideway to thereby move the disc slots relative to each other; and return means for moving the discs to the initial position such that the grooves of the first and second discs are aligned.

27. Apparatus according to claim 26 wherein the engaging means defines a ratchet mechanism adapted to incrementally pivot the discs relative to each other such that the repeated movement of the slide causes the subsequent movement of the push bar.

28. Apparatus according to claim 26 wherein the apparatus comprises a frame adapted to be securely connected to the device and carrying the shaft, wherein the frame is defined by a plurality of generally transverse, interconnected legs, a first leg including holding means for mechanically engaging the base of the device adjacent a second end thereof to prevent relative movements between the device and the frame at least in the direction of linear movements of the slide in the guideway;

the holding means including means for preventing relative movement between the base and the frame in directions transverse to the slide movement in the guideway, the holding means defined by upwardly open slots in the frame adapted to receive the base so that the apparatus can be operatively connected with the device by placing the apparatus on the ground and dropping the second end of the base in a downward direction into the slots so that the first leg of the frame supports the second end of the base on the ground during use of the apparatus.

29. An apparatus for cutting bar comprising a frame having a longitudinal axis and carrying a shaft oriented perpendicular to the longitudinal axis;

first and second axially aligned cutting discs carried on the shaft, each disc having at least one axial groove adapted to be aligned with the groove of the other disc, the grooves adapted to receive a bar to be cut;

means preventing pivotal movement of the second disc on the shaft;

means for pivoting the first disc from a first position to a second position relative to the second disc such that the grooves are substantially offset from each other, the pivoting means comprising an extension having an end secured to the first disc and extending generally radially therefrom;

a push bar having a first lower end remote from the extension linearly movable along a guideway defined by the frame and an upper second end engaging a free end of the extension, the upper end abutting the free end of the extension, abutting portions of the extension and of the push bar defining a ratchet mechanism inducing a plurality of incremental pivotal movements of the extension and the first disc only in the first direction in response to a plurality of successive linear movements of the upper end of the push bar in opposite directions.

30. Apparatus according to claim 29 comprising return means operatively coupled with the extension and the push bar for selectively moving the first disc in the opposite direction from the second position to the first position.

* * * * *